US008590610B1

(12) United States Patent
Keast

(10) Patent No.: US 8,590,610 B1
(45) Date of Patent: Nov. 26, 2013

(54) TOP DRIVE WITH INTEGRAL TRAVELING BLOCK AND AIRLIFT THREAD COMPENSATOR

(71) Applicant: Larry G. Keast, Houston, TX (US)

(72) Inventor: Larry G. Keast, Houston, TX (US)

( * ) Notice: Subject to any disclaimer, the term of this patent is extended or adjusted under 35 U.S.C. 154(b) by 0 days.

(21) Appl. No.: 13/780,738

(22) Filed: Feb. 28, 2013

(51) Int. Cl.
*E21B 19/00* (2006.01)

(52) U.S. Cl.
USPC ..... 166/75.11; 166/77.1; 166/85.11

(58) Field of Classification Search
USPC ..... 166/77.1, 77.51, 75.11, 85.1, 85.4, 166/75.14
See application file for complete search history.

(56) References Cited

U.S. PATENT DOCUMENTS

| | | | | |
|---|---|---|---|---|
| 3,838,613 | A | 10/1974 | Wilms | |
| 4,421,179 | A | 12/1983 | Boyadijeff | |
| 7,559,380 | B1 * | 7/2009 | McKnight | 175/203 |
| 7,921,939 | B1 | 4/2011 | Keast et al. | |
| 7,984,757 | B1 | 7/2011 | Keast et al. | |
| 8,127,836 | B1 | 3/2012 | Keast et al. | |
| 2012/0125692 | A1 * | 5/2012 | Rodgers | 175/114 |

* cited by examiner

*Primary Examiner* — David Bagnell
*Assistant Examiner* — Elizabeth Gitlin
(74) *Attorney, Agent, or Firm* — Buskop Law Group, PC; Wendy Buskop

(57) ABSTRACT

A top drive assembly arranged to travel in a derrick. An important use of this assembly is to manipulate tubulars in a wellbore, so it includes a traveling block housing and sheaves disposed about a compensating airbag. The airbag is arranged to prevent damage to the threads during screwing and unscrewing operations of tubulars in a wellbore. The arrangement of the airbag requires only a single air valve thus having only a single leak path.

5 Claims, 5 Drawing Sheets

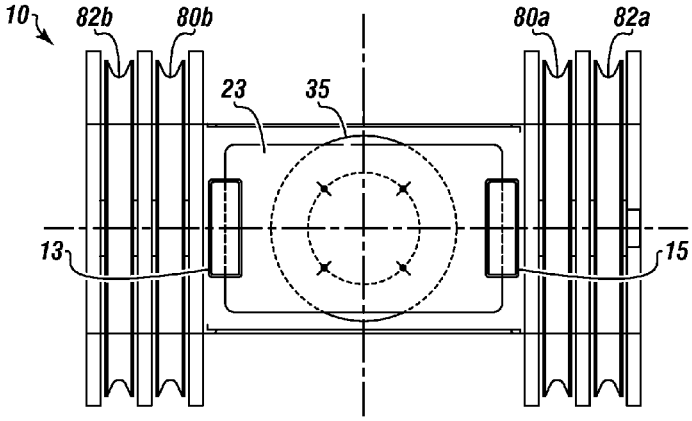
FIGURE 3
FIGURE 4
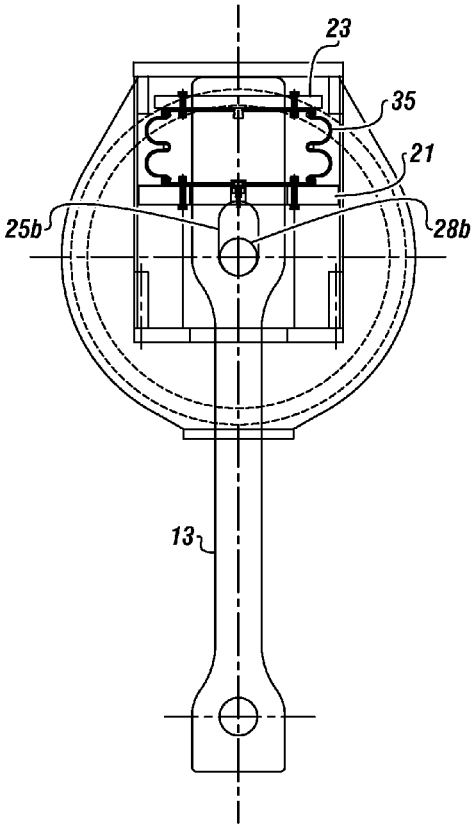
FIGURE 5
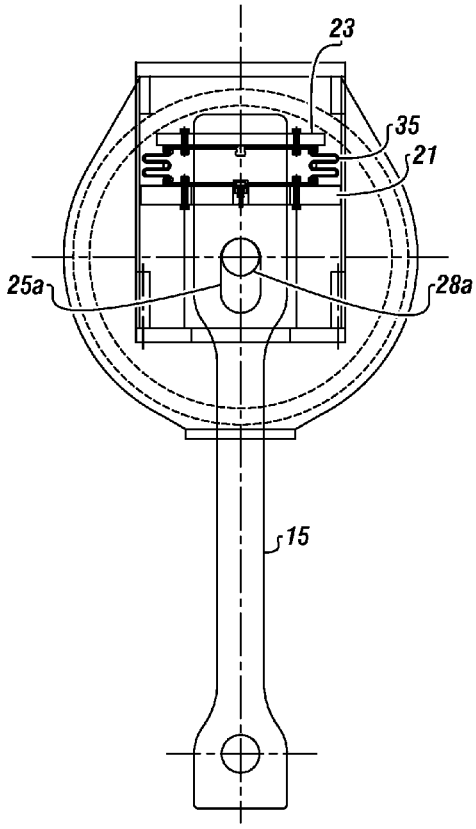

TOP DRIVE WITH INTEGRAL TRAVELING BLOCK AND AIRLIFT THREAD COMPENSATOR

FIELD

The present embodiments generally relate to a top drive with an airlift thread compensator without the need for an additional traveling block.

BACKGROUND

Top drives need secure arrangements to allow load to transfer during drilling.

A need exists for a top drive with airlift compensator that provides a more secure load transfer than a top drive supported by a hook and avoids the need for a traveling block.

The present embodiments meet these needs.

BRIEF DESCRIPTION OF THE DRAWINGS

The detailed description will be better understood in conjunction with the accompanying drawings as follows:

FIG. 3 depicts a top view of the traveling block housing of FIG. 1.

FIG. 4 depicts a side view of the top drive housing of FIG. 1 with the airlift thread compensator in an extended position, not compressed.

FIG. 5 depicts a side view of the top drive housing of FIG. 1 with the airlift thread compensator in a compressed position.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a top drive with an airlift thread compensator without the need for an additional traveling block.

The present embodiments relate to a top drive with an airlift thread compensator that provides a more secure load distribution when the top drive is operating.

In one or more embodiments, a top drive having an airlift thread compensator can have an airbag with a valve for supporting weight of the top drive during threadable engagement and disengagement of tubulars using the top drive, thereby reducing or eliminating the need for high pressure gas and reducing the number of points of failure of the overall system.

The top drive assembly can be used on a drilling rig, which can be used for drilling a wellbore.

The term "top drive assembly" as used herein can refer to a traveling block housing with sheaves, an airbag, pins, an air valve and links installed, and a top drive.

In an embodiment, the sheaves can be wire rope sheaves used for suspending the top drive assembly in a drilling rig derrick.

When the top drive assembly is first hung in the drilling rig derrick, no drill pipe is attached to the top drive.

Figure 1:
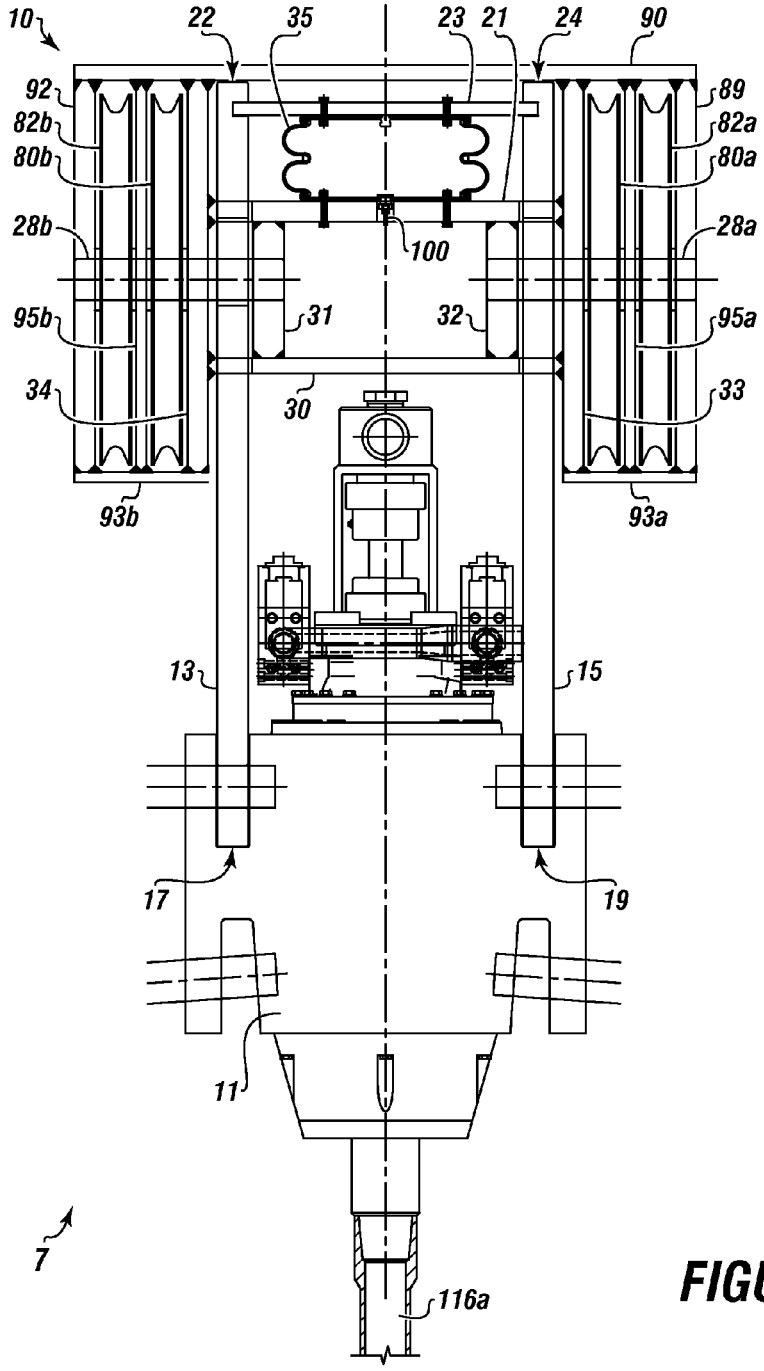
FIG. 1 depicts a front detailed view of a top drive with an airlift thread compensator with the airlift thread compensator in an extended, non-compressed position.

Turning now to the Figures, FIG. 1 depicts a front detailed view of a top drive with an airlift thread compensator with the airlift thread compensator in an extended, non-compressed position.

A top drive assembly 7 can include a top drive 11 and can engage a tubular 116*a*.

The top drive 11 can be connected to a first link first end 17 of a first link 13. The top drive 11 can be connected to a second link first end 19 of a second link 15.

The first link 13 can be connected at a first link second end 22 to an upper airbag plate 23. The second link 15 can be connected at a second link second end 24 to the upper airbag plate 23. In one or more embodiments, the links can be made of steel.

The upper airbag plate 23 can be made of steel with a thickness sufficient to resist deformation when a load is supplied.

In one or more embodiments, a first pin 28*a* and a second pin 28*b* can function as both load carrying pins and as axles for at least one sheave.

The first link second end 22 and the second link second end 24 can be attached to the upper airbag plate 23 in a floating manner, in a loose slot.

The first link second end 22 and the second link second end 24 can be contained within a traveling block housing 10. The traveling block housing can be made of steel.

The traveling block housing 10 can have an upper plate 90. A first outside plate 89 can extend from the upper plate 90. A first lower plate 93*a* can be connected to the first outside plate 89, such as at a right angle.

A first inside plate 33 can be connected to but spaced apart from the first lower plate 93*a*. The first inside plate 33 can be parallel to the first outside plate 89.

The first pin 28*a* extends through a hole in the first inside plate 33.

A first sheave 80*a* can be contained between the first outside plate 89 and the first inside plate 33 using the first pin 28*a* as an axle. The first sheave can freely rotate on the first pin 28*a*.

A third sheave 82*a* can also be positioned between the first outside plate 89 and the first inside plate 33 adjacent the first sheave 80*a* to provide two sheaves working in tandem.

In one or more embodiments, a first middle plate 95*a* can be used to separate the first sheave 80*a* from the third sheave 82*a* and provide additional support between the upper plate 90 and the first lower plate 93*a* when a pair of sheaves is used. When a pair of sheaves is used, the first pin 28*a* can extend through both sheaves, acting as an axle for both sheaves.

A second outside plate 92 can extend from the upper plate 90. A second lower plate 93*b* can be connected to the second outside plate 92, such as at a right angle.

In one or more embodiments, both the first outside plate 89 and the second outside plate 92 can have a thickness from 2 percent to 50 percent greater than the first and second lower plates 93*a* and 93*b*.

A second inside plate 34 can be connected to but spaced apart from the second lower plate 93*b*. The second inside plate 34 can be parallel to the second outside plate 92

The second pin 28*b* can extend through a hole in the second inside plate 34.

A second sheave 80*b* can be contained between the second outside plate 92 and the second inside plate 34 using the second pin 28*b* as an axle. The second sheave can freely rotate on the second pin 28*b*.

A fourth sheave 82*b* can also be positioned between the second outside plate 92 and the second inside plate 34 adjacent the second sheave 80*b*.

The second pin 28*b* can serve as an axle for both the second and fourth sheave simultaneously.

In one or more embodiments, a second middle plate 95*b* can be used to separate the second sheave 80*b* from the fourth sheave 82*b* when the pair of sheaves is used.

A lower airbag plate 21 can be connected between the first inside plate 33 and the second inside plate 34. The lower airbag plate 21 can be parallel to the upper airbag plate 23.

A lower center housing plate 30 can be connected parallel to but spaced apart from the lower airbag plate 21 and connected between first inside plate 33 and the second inside plate 34.

The first pin 28*a* can extend through a slot into a second load carrying plate 32 for load transfer. The second pin 28*b* can extend through a slot into a first load carrying plate 31 for load transfer. In one or more embodiments, each pin can extend from the first and the second load carrying plates though one of the links and the sheaves.

The first load carrying plate 31 and the second load carrying plate 32 can be connected at right angles to and between the lower airbag plate 21 and the lower center housing plate 30 as well as and between the first link 13 and the second link 15.

The first link 13 and the second link 15 can pass through the lower airbag plate 21.

An airbag 35 can be located between the upper airbag plate 23 and the lower airbag plate 21.

The airbag 35 can be inflated to raise the weight of the top drive or allowed to compress using an air valve 100, which can be connected to a low pressure compressed gas source, such as an air source with less than 300 psi. The air valve 100 can be operable using an inflator, such as a Schrader valve. The inflator can be used to inflate the airbag 35, raising the links supporting the top drive from a first position to a second position. The air valve 100 can be used to deflate, at least partially, the airbag 35, enabling the links supporting the top drive to move from the second position to another position, such as the first position.

The airbag 35 can be used to support and/or suspend weight of the entire top drive, such as during any making or breaking of tubulars or stands of tubulars using the top drive.

The airbag can replace hydraulically operable systems that are currently used in the art to support and/or suspend the weight of top drives.

The airbag can operate more reliably than hydraulic cylinders connected to high pressure gas accumulators, such as nitrogen accumulators, which can require pressures of over 500 psi and up to 2000 psi. The airbag can operate at substantially lower pressures, making it much safer for operators, and less prone to explosions.

Many currently used systems require the use of complicated, leak prone, hydraulically operated systems that require numerous hoses and fittings, hydraulic parts, piston seals, rod seals, accumulator seals, fittings, connectors, valves, hydraulic cylinders, and high pressure gas accumulators.

High pressure gas is not normally available on drilling rigs; whereas the present system with a low psi airbag can utilize standard compressed air sources which provide little pressure, such as 120 psi, to provide pressurization to the airbag.

In one or more embodiments, air provided from the compressed air source can be at a pressure from about 60 psi to about 70 psi, depending upon the weight of the top drive. Use of high pressure gas and high pressure gas accumulators can require trained operators due to the dangers involved. The unique use of the airbag described herein can thereby eliminate the need for costly, dangerous, and otherwise unnecessary equipment and training.

The top drive assembly with airbag provides fewer points of failure, such as leaks, compared to hydraulic systems. In the event of a failure of a hydraulic system, an operator has to shut the entire system down and check every single potential point of failure and make repairs before resuming operation of the system. The airbag described herein can include a simple single inflator valve, depicted as air valve 100, which can be the sole leak path.

This single inflator valve or air valve can be the only connection point of the airbag that can be a potential point of failure. Therefore, upon occurrence of a failure of the system with the airbag, an operator only needs to check the inflator valve for repairs, and the airbag itself for damage, before resuming operation of the system. Therefore, the airbag reduces the amount of system shut down time and the number of points of failure of the system.

The airbag can have a toroidal shape, a double toroidal, or another shape.

In operation, the inflator valve or air valve 100 can be a valve stem configured to receive compressed air from a compressed air source for inflating the airbag.

The inflator valve can be used with low pressure air, also called "rig air," from a compressed air source, such as an air compressor.

The inflator valve can be the same type of valve used in vehicle tires, therefore providing an equivalent level of safety and reliability.

The airbag can be inflated by transmitting pressurized air into the airbag through the inflator valve or air valve 100. The airbag can be inflated until an assembled weight of the top drive is lifted and supported.

Figure 2:
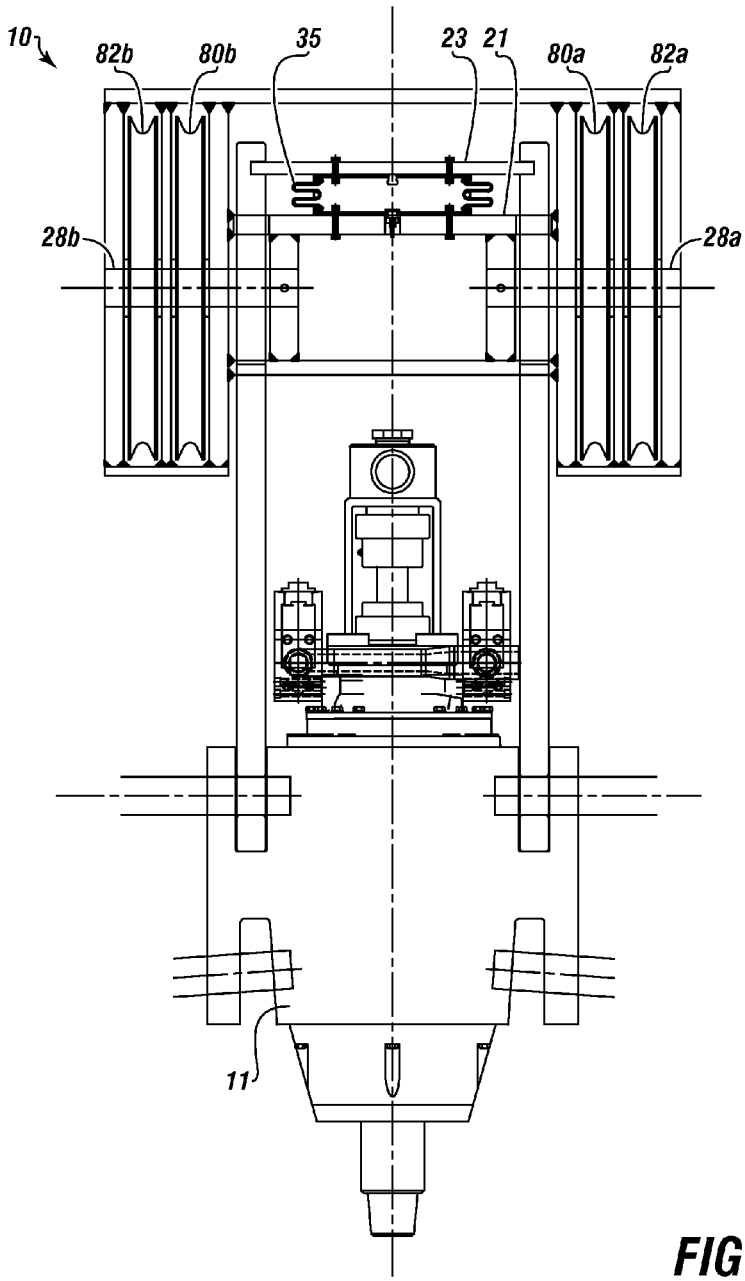
FIG. 2 depicts a front detailed view of the top drive of FIG. 1 with the airlift thread compensator in a compressed position.

FIG. 2 depicts a front detailed view of the top drive of FIG. 1 with the airlift thread compensator in a compressed position.

The first sheave 80*a*, second sheave 80*b*, third sheave 82*a*, and fourth sheave 82*b* are shown in the traveling block housing 10.

When the sheaves 80*a*, 80*b*, 82*a*, and 82*b* are hoisted by a drilling rig wire rope to raise the drill pipe or tubular load secured to the top drive 11, the airbag 35 compresses.

The first sheave 80*a* and the third sheave 82*a* can use the first pin 28*a* as an axle. The second sheave 80*b* and the fourth sheave 82*b* can use the second pin 28*b* as an axle.

The airbag 35 is depicted between the upper airbag plate 23 and the lower airbag plate 21.

FIG. 3 depicts a top view of the traveling block housing of FIG. 1.

The first sheave 80*a* and the third sheave 82*a* can form a first pair of sheaves and can be adjacent the second link 15. The second sheave 80*b* and the fourth sheave 82*b* can form a second pair of sheaves and can be adjacent the first link 13.

The traveling block housing 10 and the airbag 35 are shown. The airbag 35 can be disposed beneath the upper airbag plate 23.

FIG. 4 depicts a side view of the top drive housing of FIG. 1 with the airlift thread compensator in an extended position, not compressed.

A second slot 25*b* can be formed on the first link 13 at the first link second end.

The second pin 28*b* can extend through the second slot 25*b* at a first position while the airbag 35 is in the non-compressed position or extended position.

The upper airbag plate 23 can be attached to the airbag 35 opposite the lower airbag plate 21.

When the airbag is inflated though the air valve, the first pin and the second pin can both be in a lower position in the slots of the links simultaneously and can be used to raise the top drive to a first raised position.

FIG. 5 depicts a side view of the top drive housing of FIG. 1 with the airlift thread compensator in a compressed position.

A first slot 25*a* can be formed on the second link 15 at the second link second end.

The first pin 28*a* can extend through the first slot 25*a* at a second position while the airbag 35 is in a compressed position.

The upper airbag plate 23 can be attached to the airbag 35 opposite the lower airbag plate 21.

In operation, each link can slidably engage a pin within each respective slot, and move simultaneously from a first position to a second position and back to a first position as the airbag is expanded and compressed, by the insertion or removal of air or another gas into the airbag through the air valve.

The airbag can receive and support at least a portion of the weight of the links and anything connected to the links. In one or more embodiments, the airbag can be used to support and/or raise ten thousand pounds or more.

When the airbag is compressed, the first pin and the second pin can both be in a second location.

The airbag can be inflated sufficiently to raise the top drive to a floating position, to a location that is greater than the length of the drill pipe thread. The pins do not necessarily need to move all the way to the top of the slots. Without the floating function, the weight of the top drive can damage the threads as it is unscrewed past the first thread.

The top drive assembly in drilling can enable a drilling rig to add lengths of drill pipe, making up drill pipe together. The top drive assembly can be lowered using the sheaves to the drill pipe stand. Because the top drive is floating on the airbag and the links are floating on the pins, the thread of the drill pipe cannot be damaged.

Figure 6:
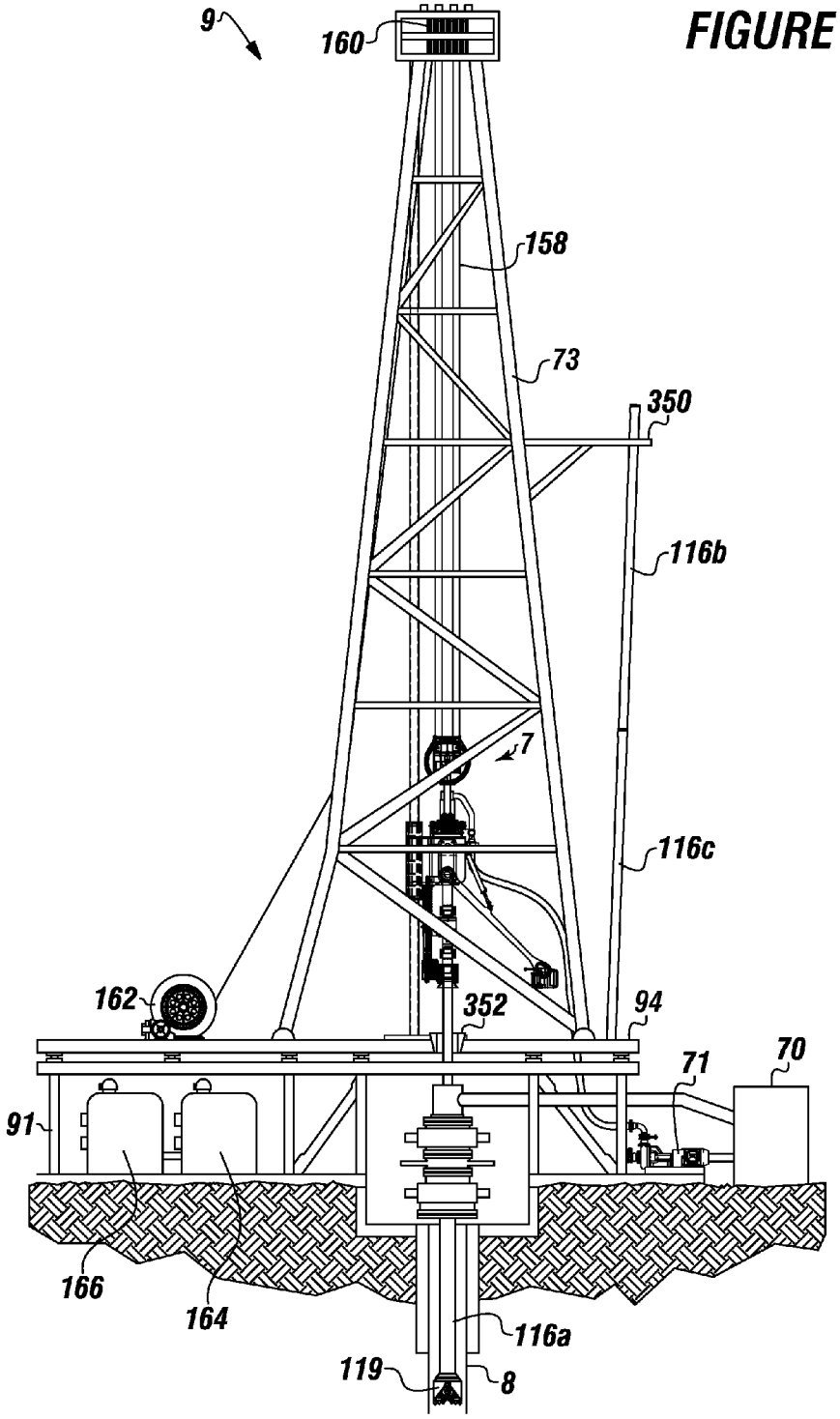
FIG. 6 depicts a drilling rig positioned over a wellbore with a top drive assembly.

FIG. 6 depicts a drilling rig positioned over a wellbore with a top drive assembly.

The drilling rig 9 can support a derrick 73 and can be positioned over a wellbore 8. The derrick 73 can include a crown block 160 for supporting the top drive assembly 7.

The derrick 73 can be used to install a tubular 116*a* into the wellbore 8. A drill bit 119 can be attached to the tubular 116*a*. Additional tubulars 116*b* and 116*c* can be threaded to the tubular 116*a* in the wellbore 8 using the top drive assembly 7.

The top drive assembly 7 can be used for engaging a tubular or a stand of tubulars, such as tubular 116*a*, which can be a drill pipe extending from the rig floor 94, through the substructure 91, and into a wellbore 8.

Engines 164 and 166 can be located beneath the substructure 91 and the rig floor 94 for use in drilling operations.

Wire rope 158 can be used to raise and lower the top drive assembly 7. Drawworks 162 can be used to operate the wire rope 158, which can be connected to the sheaves in the top drive assembly 7.

Additionally, the drilling rig 9 can include a fluidly connected mud pump 71 with a mud tank 70 for pumping drilling mud into the wellbore 8.

A racking board 350 for holding the tubulars prior to being formed into a drill string with the tubulars is shown, as well as slips 352.

In an embodiment, the top drive assembly includes a rotatable stem and a motor spinably connected to the rotatable stem. In one or more embodiments, a heavy thrust bearing can be disposed about the rotatable stem.

Figure 7:
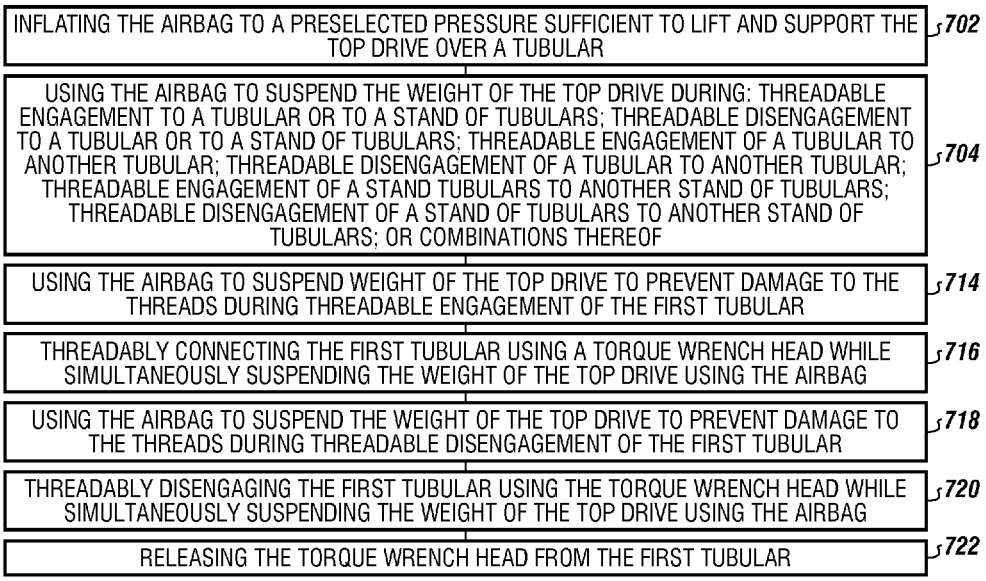
FIG. 7 depicts a sequence of steps to operate the top drive assembly according to one or more embodiments.

FIG. 7 depicts a sequence of steps to operate the top drive assembly according to one or more embodiments.

The method of operation can include inflating the airbag to a preselected pressure sufficient to lift and support the top drive over a tubular, as illustrated by box 702.

The method can include using the airbag to suspend the weight of the top drive during: threadable engagement to a tubular or to a stand of tubulars; threadable disengagement to a tubular or to a stand of tubulars; threadable engagement of a tubular to another tubular; threadable disengagement of a tubular to another tubular; threadable engagement of a stand tubulars to another stand of tubulars; threadable disengagement of a stand of tubulars to another stand of tubulars; or combinations thereof; as illustrated by box 704.

The method can include using the airbag to suspend weight of the top drive to prevent damage to the threads during threadable engagement of the first tubular, as illustrated by box 714.

The method can include threadably connecting the first tubular using a torque wrench head while simultaneously suspending the weight of the top drive using the airbag, as illustrated by box 716.

The method can include using the airbag to suspend the weight of the top drive to prevent damage to the threads during threadable disengagement of the first tubular, as illustrated by box 718.

The method can include threadably disengaging the first tubular using the torque wrench head while simultaneously suspending the weight of the top drive using the airbag, as illustrated by box 720.

The method can include releasing the torque wrench head from the first tubular, as illustrated by box 722.

While these embodiments have been described with emphasis on the embodiments, it should be understood that within the scope of the appended claims, the embodiments might be practiced other than as specifically described herein.

What is claimed is:

1. A top drive assembly for use on a drilling rig comprising:

a. a traveling block housing with an upper plate;

b. an airbag mounted to a lower airbag plate of the traveling block housing;

c. an upper airbag plate mounted to the airbag opposite the lower airbag plate of the traveling block housing;

d. a first link having a first link second end connected to the upper airbag plate, wherein the first link has a second slot;

e. a second link having a second link second end connected to the upper airbag plate, wherein the second link has a first slot;

f. a first sheave between a first outside plate and a first inside plate of the traveling block housing;

g. a third sheave between a second outside plate and a second inside plate of the traveling block housing;

h. a first pin serving as an axle and as a load transfer pin extending through the first sheave to a second load carrying plate of the traveling block housing;

i. a second pin serving as an axle and as a load transfer pin extending through the third sheave to a first load carrying plate of the traveling block housing;

j. a center housing plate between the first inside plate and the second inside plate;

k. a top drive for engaging a tubular, wherein the top drive is supported by the traveling block housing through a first link first end of the first link and through a second link first end of the second link, and wherein the top drive is independently movable with respect to the sheaves; and l. an air valve secured to the airbag for injecting low pressure air at less than 300 psi from an air source into the airbag to expand the airbag, lift the links, or lower the links to provide thread compensation as the top drive makes up or breaks out a drill string of tubulars.

2. The top drive assembly of claim 1, further comprising: a second sheave parallel to the first sheave and rotating on the first pin between the first outside plate and the first inside plate, and a fourth sheave parallel to the third sheave and rotating on the second pin between the second outside plate and the second inside plate.

3. The top drive assembly of claim 1, wherein the airbag is toroidal in shape or double toroidal in shape.

4. The top drive assembly of claim 1, wherein the traveling block housing consists of the first lower plate, a first middle plate between and parallel to the first inside plate and the first outside plate, a second lower plate connected to the second outside plate opposite the upper plate, and a second middle plate between and parallel to the second inside plate and the second outside plate.

5. The top drive assembly of claim 1, wherein the traveling block housing is a one piece unit.

* * * * *